US005679004A

United States Patent [19]

McGowan et al.

[11] Patent Number: 5,679,004

[45] Date of Patent: Oct. 21, 1997

[54] MYOELECTRIC FEEDBACK SYSTEM

[75] Inventors: Chris S. McGowan, San Francisco, Calif.; Somasekhar R. Kovvuri, Ronkonkoma, N.Y.; Steve G. Hostettler, Chico, Calif.

[73] Assignee: Movit, Inc., Antioch, Calif.

[21] Appl. No.: 568,956

[22] Filed: Dec. 7, 1995

[51] Int. Cl.[6] ..... A61B 5/103

[52] U.S. Cl. ..... 434/247; 128/733; 128/741; 128/782; 73/379.01; 482/900

[58] Field of Search ..... 434/247, 252, 434/253; 482/6–8, 9, 900, 901; 128/733, 734, 741, 774, 782; 473/202, 212, 215, 217, 266, 269, 270, 276, 277, 409; 73/379.01, 379.02

[56] References Cited

U.S. PATENT DOCUMENTS

| | | | |
|---|---|---|---|
| 3,916,876 | 11/1975 | Freeman | 128/733 |
| 5,263,490 | 11/1993 | Hayes et al. | 128/741 |
| 5,277,197 | 1/1994 | Church, et al. | 128/733 |
| 5,372,365 | 12/1994 | McTeigue et al. | 434/252 |
| 5,413,611 | 5/1995 | Haslam, II | 623/25 |
| 5,513,651 | 5/1996 | Cusimano et al. | 128/782 |

*Primary Examiner*—Richard J. Apley
*Assistant Examiner*—Glenn E. Richman
*Attorney, Agent, or Firm*—Michael J. Hughes; Mark E. Baze

[57] ABSTRACT

A system and method is provided for learning, training and rehabilitation in which comparison is made of representative electrical signals produced by both a teacher (12) and a student (14) during attempted replication by the student (14) of a movement behavior demonstrated by the teacher (12), with corresponding feedback to the student (14) to inform the student (14) as to whether the replication is suitably compliant to the demonstration. The preferred embodiment is a myoelectric feedback system (10) employing wireless transmission of the myoelectric signals generated by the relevant muscles of the teacher (12) and the student (14) during the demonstration and attempted replication, with vibratory feedback to the student (14) upon comparison of the myoelectric signals at a remote processing station (18). A delayed or "non-live" teaching capability is provided by a videotape processing machine (28) and a computer (30). An alternative embodiment provides that the video images of the demonstration performed by the teacher are stored in digitized form, e.g. on a CD-ROM (74). In the alternative embodiment, decision-making software (76) may be incorporated to provide for an interactive learning system.

20 Claims, 4 Drawing Sheets

MYOELECTRIC FEEDBACK SYSTEM

TECHNICAL FIELD

The present invention relates generally to learning, training and rehabilitation systems, and more particularly to a feedback system that compares movement behaviors demonstrated by a teacher with attempted replications by a student; the presently preferred embodiment employs apparatus and methods utilizing myoelectric sensory feedback.

BACKGROUND ART

In teaching and in physical therapy, it is often the case that the teacher or therapist will attempt to demonstrate a particular behavior that is to be learned in order to show by way of example the proper manner in which to carry out the behavior. This form of teaching is very well known, of course, and is instinctive in many animals. It is probably innate within the human species as well. Actual demonstration of a particular action or movement, combined with verbal instruction and self practice, presents a highly effective method of teaching and learning. For movement behaviors of any substantial complexity, learning through observation of a teacher's example may be absolutely requisite for a student to be able to learn the behavior within a reasonable amount of time and with the expenditure of a productive amount of effort.

On the other hand, it would be desirable in many situations that the student be able to "tone in" even more closely to the subtleties of the behavior demonstrated by the teacher than is possible by mere observation alone, or even by the teacher's physically guiding the student through the movement. That the movements themselves are subtle is not a prerequisite for the desirability of such an ability, because the student or patient, for whatever reason, may simply be unable to appreciate the mechanics of even relatively gross movements of a particular nature.

Shown in U.S. Pat. No. 5,277,197, issued on 11 Jan., 1994 to Church et al., is a system that uses myoelectric ("electromyographic" (EMG)) feedback for home rehabilitation and exercise training. While at a clinic, a therapist performs an EMG evaluation of a patient requiring physical therapy. A determination is made as to what would be the optimum EMG readings with respect to the damaged muscles or respective body parts were those muscles or body parts in an injury free, or less injured state. The optimized parameters are then programmed (via a computer) into a "patient module" which has electronics for the detection of the patient's myoelectric signals via appropriately positioned electrodes. When the patient subsequently attempts to produce the motional behavior to be rehabilitated using the injured muscles or body parts, the patient monitor provides a visual or audio output to inform the patient as to whether achievement of the optimized EMG readings is being met. The patient's attempts are also recorded by the patient monitor so that future evaluation may be made by the therapist of the patient's ongoing progress. The foregoing invention, while useful from a physical therapy point of view, has but little and limited application with regard to the actual teaching of movement behaviors as the teaching of such movements by teacher demonstration is traditionally understood to be carried out.

Myoelectric feedback has also been utilized in conjunction with prosthetic apparatuses. Shown in U.S. Pat. No. 5,413,611, issued on 9 May 1995 to Halsam II et al., is a computerized hand prosthesis. Electrodes detect myoelectric signals generated by the muscles at the end of the remnant portion of a patient's arm. These signals are used by a microcomputer to activate a motor that closes a mechanical hand. A vibratory device is located on the remnant portion to provide feedback to indicate to the wearer the degree of force that the mechanical hand is exerting, with different vibratory patterns or intensities indicating different grip forces. Again, utilization of the methods taught by this invention do not provide the capability to assist in interactive teaching exercises between a teacher and a student as are traditionally understood.

Shown in the Spring 1992 issue of *Music Perception*, Vol. 9, No. 3, at pp. 303–310, is an example of the use of EMG in the teaching of the playing of musical instruments. Using standard surface electrodes and EMG electronics, the EMG activity of the relevant muscles of students having both good and bad playing characteristics (with respect to vibrato) during the playing of a stringed instrument were recorded. Study of the (hard copy) EMG traces revealed that the better performing students were found to consistently have certain muscles that were either actively or passively engaged while they played the instrument. The author determined that the poorer performing students utilized those same muscles differently, and that the EMG recordings of the poor performers indicated either overly active or overly passive readings devolving from muscles that preferably should have been less passive or more active, respectively, as compared to the better performers. The method utilized, while useful to pinpoint problem areas, does not provide for contemporaneous feedback to allow the student to be informed, while actually playing the instrument, that his or her performance is in some manner deficient. Thus, the speed with which adjustments in playing technique may be made, and the speed with which improvement may be obtained thereby, is substantially retarded.

Because presently available methods as employ myoelectric feedback are of limited assistance in traditional, demonstrational teaching, a substantial need still exists for a myoelectric feedback system that provides contemporaneous feedback to a student or patient during the actual demonstration by the teacher and attempted replication by the student or patient of the movement behavior to be learned, so that the learning time may be reduced and the subtleties of the movement behavior demonstrated enhanced for more efficient teaming or rehabilitation thereby. In fact, the inventors are aware of no system, incorporating myoelectric detection or otherwise, that provides for feedback to a student based on a direct or substantially direct comparison of motional behavior demonstrated by a teacher and an attempted replication thereof by a student.

DISCLOSURE OF THE INVENTION

Accordingly, it is an object of the present invention to provide a system for training and rehabilitation that provides comparative feedback to a student during an attempted replication by the student of a movement behavior demonstrated by a teacher in either a "live" or "non-live" capacity.

It is another object of the invention to provide a system for neuromuscular training and rehabilitation that provides feedback to a student based on a comparison of the corresponding myoelectric signals produced by a teacher and the student during demonstration of certain motional behaviors by the teacher and attempted replication of those behaviors by the student.

It is a further object to provide a comparative feedback system for teaching and learning that provides feedback to a student whereby such feedback indicates the degree to which an attempted replication by the student is suitably compliant to a behavior demonstrated by a teacher.

It is yet another object to provide a myoelectric feedback system that provides for wireless transmission of the myoelectric signals generated by the teacher and student and of the feedback signals based on a comparison of the same.

It is yet a further object to provide a myoelectric feedback system wherein myoelectric signals of a teacher generated during a previously videotaped or otherwise recorded demonstration are stored for a delayed comparison with those of a student upon a later attempted replication by the student of the behavior demonstrated by the teacher.

It is still another object to provide a comparative feedback system that has a delayed performance and comparison capability and which uses decision-making software to allow for interactive sessions between the student and a non-live version of the teacher.

It is yet another object to provide a comparative feedback system which allows broader access by students and devotees to the teaching capabilities of world-renowned teachers or experts beyond what may be provided by mere audio and/or visual recordings of such teachers or experts alone.

It is still a further object of the present invention to provide a comparative feedback system which allows for a historical recordation of the teaching capabilities and intrinsic knowledge of physical movement and behavior held by teachers or experts beyond what may be provided by simple audio and/or visual recordation of such teachers or experts alone.

Briefly, the preferred embodiment of the present invention is a myoelectric feedback system for contemporaneous comparison of the myoelectric signals generated by both a teacher and a student (or a therapist and a patient) during the student's attempted replication of a movement behavior demonstrated by the teacher, with corresponding vibratory feedback to the student to inform the student as to whether the student's movement behavior is suitably compliant with that of the teacher.

Attached to the muscle sites relevant to the movement behavior of interest, of both the teacher and the student, are pairs of electrodes that detect the myoelectric signals generated at those muscle sites. The electrodes are connected to beltpacks that both the teacher and the student wear. The beltpacks contain various electronics and a battery supply for the preprocessing of the myoelectric signals and for the transmission of those signals to a remote processing station. At the remote processing station, a comparator circuit makes a comparison of the myoelectric signals of the teacher and myoelectric signals of the student that have been normalized. To the extent that the signals of the student are significantly different from those of the teacher, feedback signals are sent from the remote processing station back to the student, where additional electronics in the student beltpack cause an activation of one or more vibratory devices attached in close proximity to corresponding pairs of electrodes, thereby informing the student as to which muscles may be performing in a non-compliant manner as compared with the corresponding muscles of the teacher during the performance of the same movement.

The myoelectric feedback system of the present invention also provides for delayed or "non-live" teaching by including a videotape processing machine and a computer such that the movement behaviors of the teacher, and the myoelectric signals correspondingly generated, may be recorded for future playback and learning by the student. A synchronizing circuit provides that the recorded myoelectric signals are synchronized with the videotaped image. An alternative embodiment provides that the video images of the behavior demonstrated by the teacher (and the myoelectric signals corresponding thereto) are stored in digitized form, e.g. on a CD-ROM. In this alternative embodiment, decision-making software may be incorporated to provide for an interactive system wherein the non-live teacher responds specifically to the needs of individual students. Application of the present invention within virtual reality environs and contexts is especially contemplated by the inventors.

An advantage of the present invention is that the student or patient interacts with another person (or at least a visual representation thereof) during the learning and feedback process, rather than with a machine or simple monitoring device.

Another advantage of the invention is that the student or patient is informed immediately and in a simple manner as to whether an attempted replication is sufficiently compliant with a demonstrated behavior.

A further advantage is that the student is informed as to whether compliance of movement has been obtained without necessarily having to be oriented in any particular direction to view a monitor, thereby allowing for a greater range of movement behaviors and providing for a greater number of positions in which those movement behaviors may be carried out.

Yet another advantage is that the participants may be freed from interfering wires, thereby allowing for a greater range of motion, travel, and location during the performance and attempted replication of the movement behaviors being taught.

Yet a further advantage is that the delayed usage capabilities of the feedback system make it possible for greater numbers of people to learn from world-renowned expert or teachers and, more particularly, with results that more closely approximate an individual training session with such experts or teachers than is possible through observation of a simple video and audio presentation.

Still another advantage of the present invention is that the feedback system, especially when provided with enhanced interactive capabilities as provided by decision-making software, is able to more closely meet the specific learning needs of individual students.

These and other objects .and advantages of the present invention will become clear to those skilled in the art in view of the description of the best presently known mode of carrying out the invention as described herein and as illustrated in the several figures of the drawings.

BEST MODE FOR CARRYING OUT THE INVENTION

Figure 1:
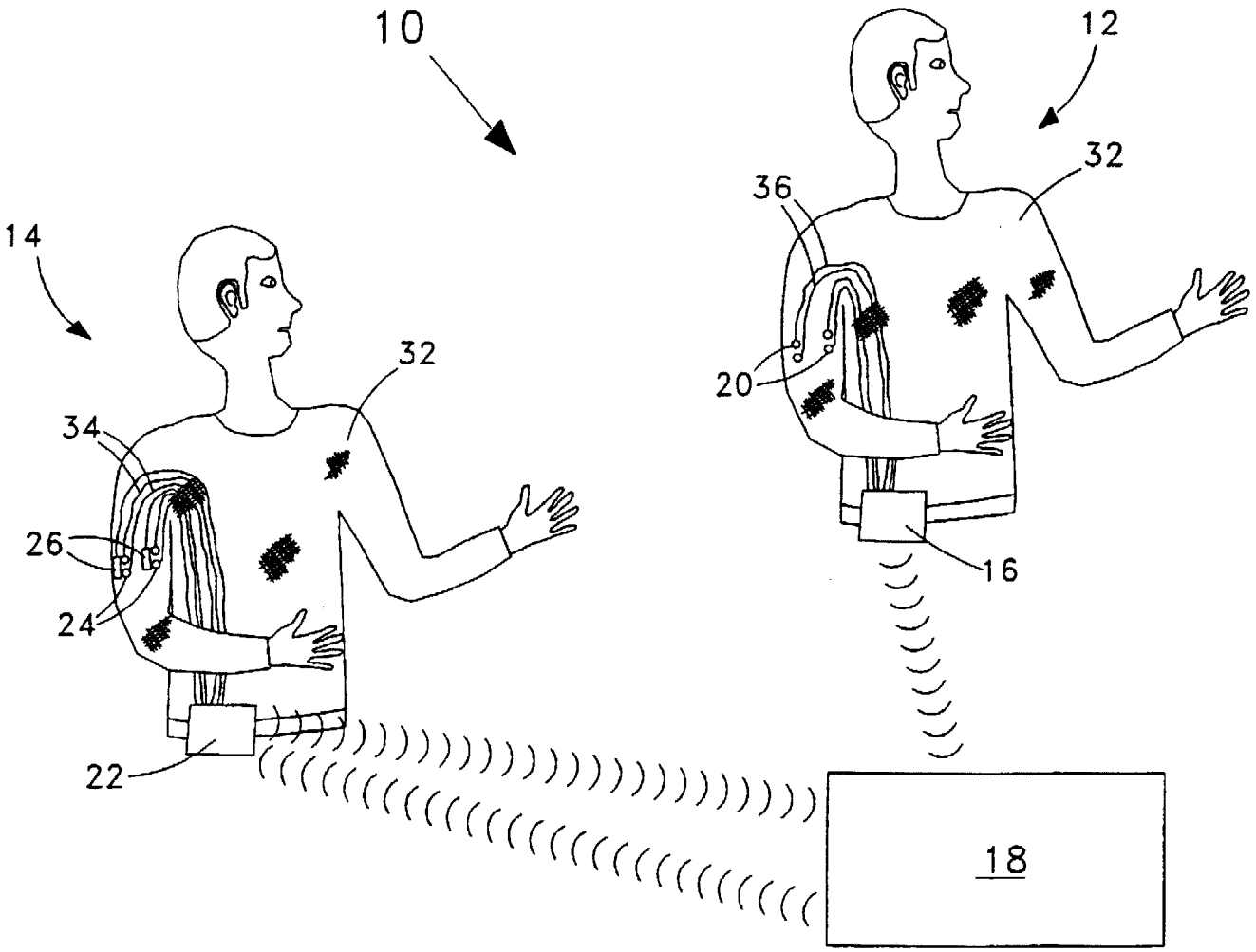
FIG. 1 is a fanciful view of the preferred embodiment of the present invention.

The preferred embodiment of the present invention is a myoelectric feedback system for neuromuscular training and rehabilitation. The myoelectric feedback system of the preferred embodiment is set forth in FIG. 1, where it is designated therein by the general reference character 10.

Referring to the view of FIG. 1 of the drawings, a therapist or teacher 12 and a patient or student 14 are shown as in a typical clinical or instructional setting in which it is desired that the student 14 learn to replicate a particular motional behavior being demonstrated by the teacher 12. In the preferred embodiment of the present invention, the teacher 12 wears a teacher beltpack 16. The teacher beltpack 16 contains various electronics and a battery supply, as will be described shortly, for the preprocessing of specific myoelectric signals that are generated by the teacher 12 and for the transmission of electrical equivalents thereof to a remote processing station 18. At the remote processing station 18, a comparative analysis with similar signals received from the student 14 takes place. Two pairs of teacher electrodes 20 are electrically connected to the teacher beltpack 16 and are used to detect the myoelectric signals from the muscle sites of the teacher 12 that have been determined to be relevant to the movement being taught.

In FIG. 1, the teacher electrodes 20 are shown as being placed in contact with muscles of the arm, but the electrodes 20 may be placed anywhere else on the body where suitable myoelectric signals exist. To the extent that it is possible (or practicable) for the student 14 to be cognizant of multiple sensory feedback (the nature of which is described below), the performance of a number of different muscles and/or muscle sites may be monitored simultaneously. Depending on the nature of the movement being taught or rehabilitated, pairs of electrodes 20 might be positioned on both of the arms of the teacher 12 and of the student 14, both of the legs, or on one arm and one leg, etc. And, of course, placement of the electrodes 20 is not limited to the human limbs. In the preferred embodiment, at least one electronic amplifying and filtering channel (described in more detail below), with input derived from one pair of electrodes 20, is provided for each site of muscle activity.

The student 14 similarly wears a student beltpack 22 containing a battery supply and an electronic system with preprocessing and transmission components that are essentially identical to those contained in the teacher beltpack 16, but containing, in addition, electronics for the reception of electrical feedback signals transmitted to the student 14 by the remote processing station 18. Two pairs of student electrodes 24 are electrically connected to the student beltpack 22. The student electrodes 24 are positioned so as to be able to detect the myoelectric signals generated by the muscles of the student 14 which mirror those of the teacher 12 and under concurrent detection by the teacher electrodes 20. Student feedback devices 26 are located in close proximity to the pairs of student electrodes 20 and provide sensory input feedback in the form of vibratory stimulation, such sensory input enabling the student 14 to know whether his or her movement behavior is acceptably compliant with the movement being demonstrated by the teacher 12. The juxtaposition of a feedback device 26 and the corresponding pair of electrodes 24 permits the student 14 to know precisely which muscles are performing improperly. After the receipt of sensory input through a feedback device(s) 26, the student 14 may either then be immediately aware of which aspect and to what extent the movement being performed requires enhancement, attenuation, or modification, as based on past experience and/or through preliminary verbal explanation by the teacher 12 or, if necessary, the student 14 may inquire of the teacher 12 for further exposition and analysis of the inaccurate replication.

The remote processing Station 18 contains a variety of electronics, including electronics for reception of the electrical signals transmitted by the teacher and student beltpacks (16 and 22), electronics for comparison of these signals, and electronics for transmission of electrical (feedback) signals back to the student 14 based on the comparison. The electronic comparison that is performed produces electrical information that corresponds to the degree of nonconformity of the myoelectric signal generated by the muscles of the student 14 relative to those of the teacher 12 when the student 14 attempts to replicate a movement performance of the teacher 12. The remote processing station 18 transmits this electrical information to the student beltpack 21, where circuitry is provided so that activation of the student feedback device(s) 26 may then be caused to occur as appropriate. Thus, when the student 14 utilizes his or her monitored muscles in a manner sufficiently different from that demonstrated by the teacher 12, the student feedback device(s) 26 will be selectively turned on by a transmission(s) from the remote processing station 18 and the student 14 will be notified of an existing nonconformity thereby.

Since it is not intended that the myoelectric feedback system 10 of the present invention be limited to "real time" feedback from a "live" teacher 12, the remote processing station 18 of the preferred embodiment also includes components to provide for delayed teaching and for a nonconcurrent detection of the myoelectric signals produced by the teacher 12 and the student 14. Thus, a videotape processing machine 28 (see FIG. 3) provides for the prior pictorial and verbal recordation of the teacher 12 carrying out the movement behavior to be learned, and for the subsequent playback thereof when it is inconvenient or impracticable for the teacher 12 to teach and perform before the student 14 in a "live" capacity. A computer 30 (see FIG. 3) allows for the storage, and for the subsequent recall, of the myoelectric signal equivalents transmitted by the teacher beltpack 16 to the remote processing station 18 during the videotaping process. Towards this end, the remote processing station 18 includes electronics (to be described) for the conversion of these electrical signals into a computer storable form. Electronics are also provided for the reconversion of the stored myoelectric information into electrical signals that may then be compared with the real time electrical signals generated by the student 14 when the student 14 views the videotape of the teacher 12 and simultaneously attempts to replicate the teacher's 12 movements. Additional electronics are provided for the synchronization of the videotape with the stored myoelectric signal equivalents produced by the teacher 12.

A more detailed description of the various electronic systems and components as comprise the myoelectric feedback system 10 of the present invention now follows. It is emphasized that the necessary specific configuration of each of the electronic channels (and of the circuitry embodied therein) will be apparent to those skilled in the art in view of the functions to be performed, and that the particular components and array as selected do not constitute an exhaustive listing and instead represent only a single, presently preferred embodiment of the invention.

Still referring to FIG. 1, the teacher and student electrodes (20 and 24), as indicated, enable the myoelectric signals generated by the associated muscles to be acquired for comparative feedback purposes. The electrodes (20 and 24) are bipolar, surface-recording electrodes of the variety as are commonly commercially available. Depending on the performance capability and precise type of electrodes (20 and 24), it may or may not be necessary to apply a conducting electrode gel between the electrodes (20 and 24) and skin surfaces. Similarly, skin preparation may or may not be required. In the preferred embodiment, the electrodes (20 and 24) are positioned and held in contact with the skin covering the relevant muscles by means of a body suit 32. The electrodes (20 and 24) are attached to the inner surface of the body suit 32, while pairs of insulated flexible leads 34 and 36, which are connected to the teacher electrodes 20 and the student electrodes 24, respectively, run between two layers of the body suit 32 and terminate at the teacher or student beltpacks (16 or 22). The body suit 32 is fabricated of an elastic material, which helps insure that an intimate contact between the electrodes (20 and 24) and the skin is maintained at all limes during the performance of a range of motions. Of course, the electrodes (20 and 24) may be positioned in a less convenient manner, but with somewhat greater specificity, using the more conventional technique in which an elastic band or an adhesive material such as tape is used to apply the electrodes (20 and 24) to the skin of each of the muscle sites of interest. The leads (34 and 36) are sufficiently long and are routed so as to not be an impediment to movement.

Variation in the precise manner of placement of the electrodes (20 and 24) on the skin, and in the routing of the leads (34 and 36) thereto, is to be expected depending on the nature of the application to which the myoelectric feedback system 10 is applied and the vigor with which it is necessary to perform the movement to be replicated. Thus, while the placement of the electrodes (20 and 24) as shown in the drawings might be suitable for the monitoring of certain of the arm muscles during a teaching session for either of the serving of a tennis ball, the playing of a violin, or the rehabilitating of an injured arm, the actual attachments of the electrodes (20 and 24) and leads (34 and 36) may vary.

The myoelectric signals which are produced upon neural stimulation of the associated muscles are of a relatively low level. Because of this low level, and because of the presence of "crosstalk" produced by antagonist and other muscles lying in dose proximity to the muscle sites of interest, the myoelectric signals to be detected are generally beset with noise problems and hence require amplification before further useful processing and analysis may be obtained. To increase the signal levels, and referring now to the block diagram of FIG. 2, amplifiers 38 and 40, located in the teacher and student beltpacks (16 and 22), respectively, are provided. Each pair of electrodes (20 or 24) is connected to one such amplifier (38 or 40) via the leads (34 or 36). The amplifiers (38 and 40) are differential amplifiers incorporating instrumentation quality operational amplifiers and provide high input impedance and high common mode rejection ratio (CMRR). The amplifiers (38 and 40), which are equal in number to the number of muscle sites under detection, have inputs which are adequately isolated from each other. The outputs are likewise adequately isolated. It should be noted that preamplifiers (not shown) may also be incorporated into the electrode (20 and 24) packages to provide for amplification of the myoelectric signals prior to input into the amplifiers (38 and 40).

Low-pass filters 42 and 44, located in the teacher and student beltpacks (16 and 22), respectively, are provided to filter the amplified signals and eliminate high frequencies in order to produce smooth signals indicative of either onset, maintenance or decrease of a particular muscle site's activity. The filters (42 and 44) may incorporate either a combination of passive components or operational amplifiers. As is the case with the aforementioned amplifiers (38 and 40), in the preferred embodiment as presently known, one filter (42 and 44) is provided for use in conjunction with each pair of electrodes (20 and 24) and the amplifier (38 and 40) corresponding thereto.

Figure 2:
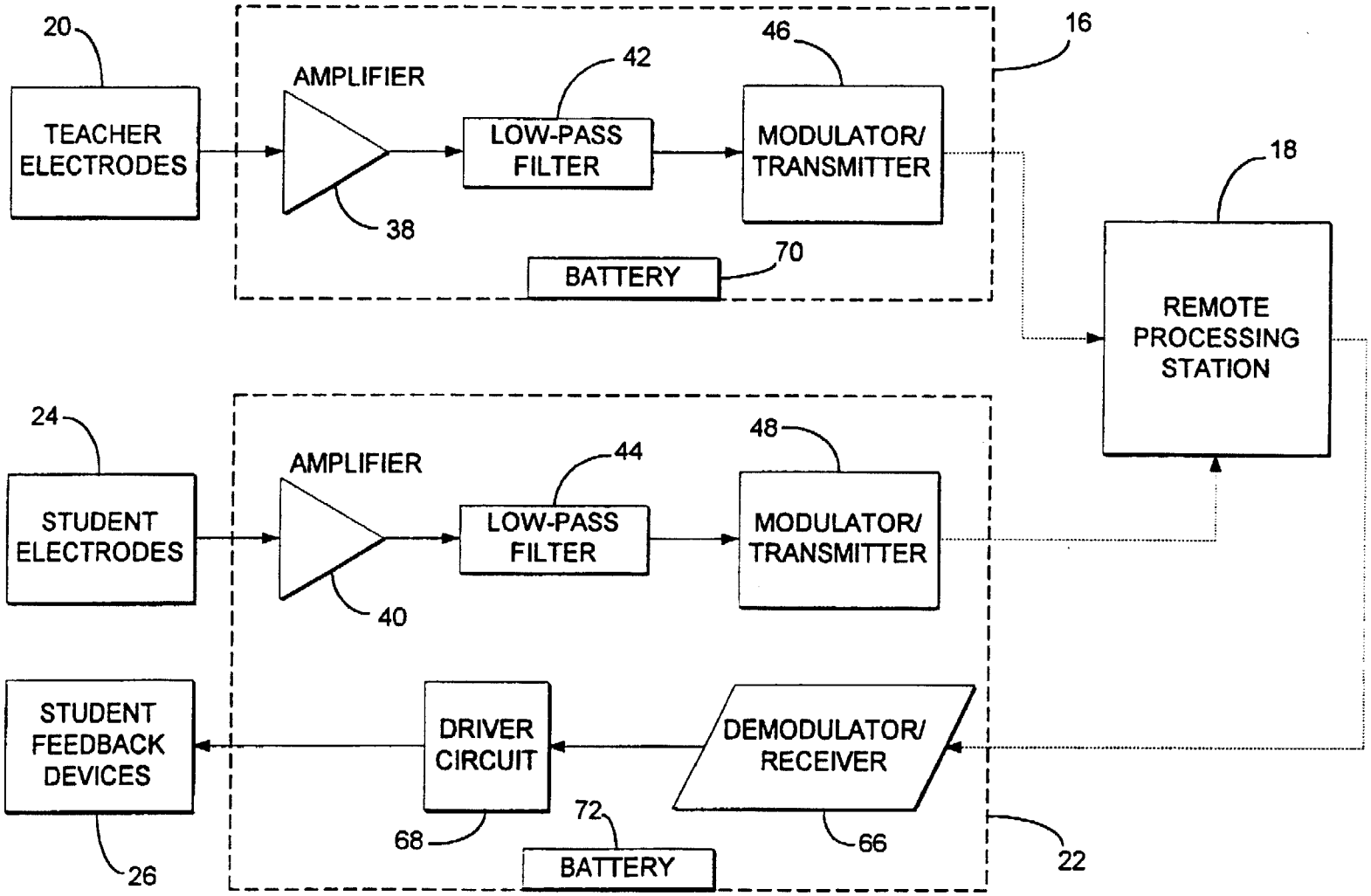
FIG. 2 is an electronics circuit block diagram of the invention of FIG. 1.
Figure 3:
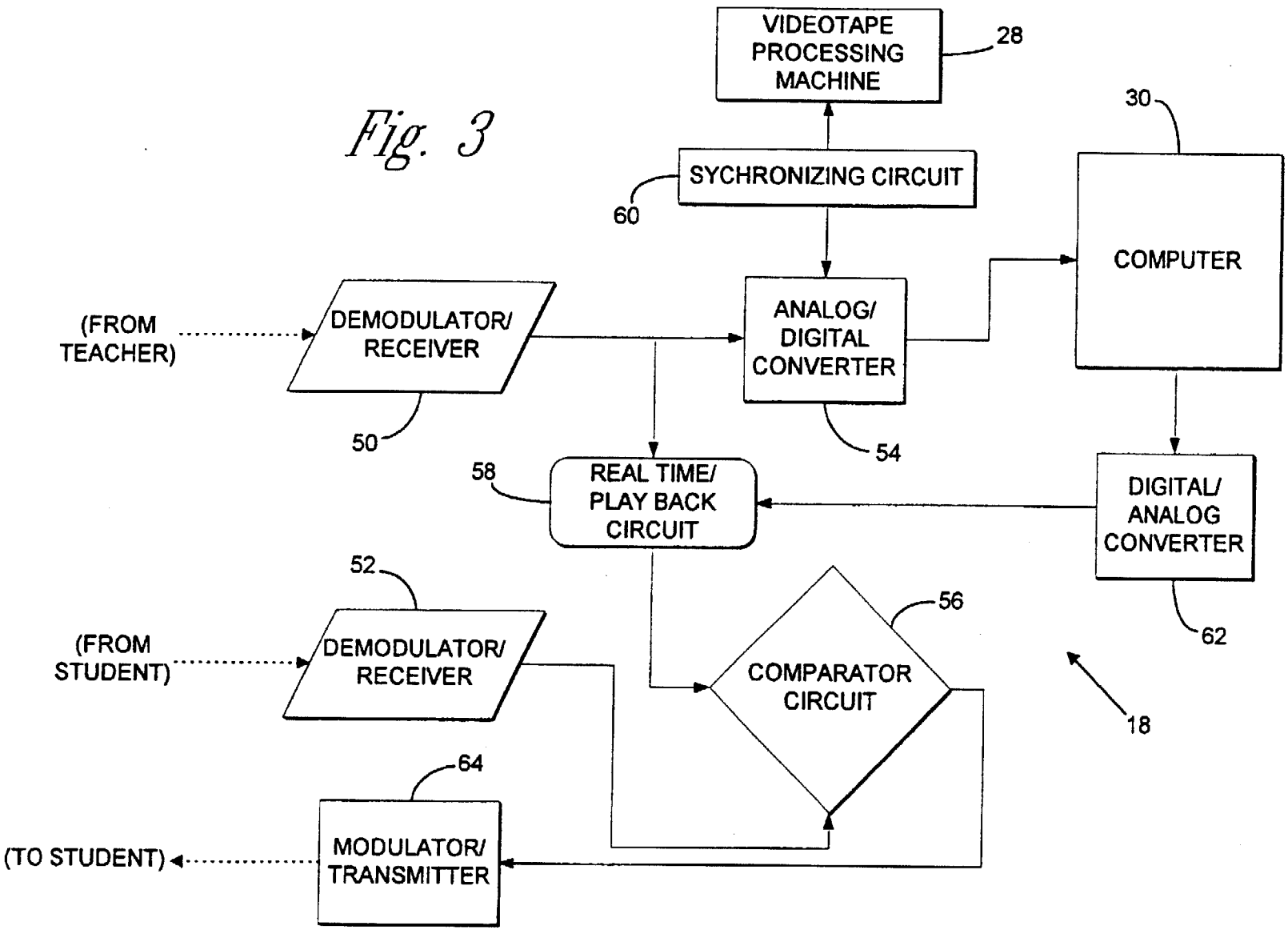
FIG. 3 is an electronics circuit block diagram of the remote processing station.

At this point, and with continuing reference to FIG. 2, the various myoelectric signals of the teacher 12 and the student 14 having been suitably amplified and filtered, it is desired that the signals be transmitted to the remote processing station 18 for comparative analysis and/or storage of the signals generated by the teacher 12 (where delayed usage of such signals is desired). Modulator/transmitters 46 and 48, of any of a number of the varieties as are available and known to those skilled in the art, are used to impress the myoelectric signal waveforms of the teacher 12 and of the student 14, respectively, onto radio carrier waves using either amplitude modulation (AM) or frequency modulation (FM). A low power transmission of the modulated signal is then made by the modulator/transmitters (46 and 48) to demodulator/receivers (50 and 52) which are located at the remote processing station 18, as shown in FIG. 3. Conventionally, selection of the radio frequencies utilized for transmission is determined by the distance between the modulator/transmitters (46 and 48) and the demodulator/receivers (50 and 52), and by anticipated surrounding environmental influences. Multiplexing, such as frequency division multiplexing, is used to provide for the simultaneous transmission of the modulated electrical signals received from all the available input channels to the corresponding demodulator/receivers (50 and 52). It is to be understood that such wireless signal transmission is not to be limited to use of the radio frequency spectrum, and that other forms of electromagnetic radiation, such as infrared, may be used to carry the myoelectric information as well, with appropriate modification of the circuitry and components described herein.

It is preferred, for reasons of mobility and coordination, to utilize a method of transmission of the myoelectric signal equivalents of the teacher 12 and the student 14 to the remote processing station 18 that does not involve the use of interfering wires or cables, hence the use of the radio transmitter/receiver system as described. However, it is to be understood that wires or cables could in fact be employed for the signal transmissions, in which case the modulator/transmitters (46 and 48) and the demodulator/receivers (50 and 52) would be made unnecessary. A multiplexing technique may be utilized in this alternative embodiment as well.

Referring to FIG. 3, the demodulator/receivers (50 and 52) are also of any of a number of the varieties as are available and known to those skilled in the art and are essentially mirror images of the circuitry present in the modulator/transmitters (46 and 48). The demodulator/receivers (50 and 52) receive and demodulate the signals transmitted by the teacher 12 and student 14, thereby providing for the remote detection of the myoelectric signals conduited by the various channels. Depending on whether recordation is desired, the demodulated myoelectric signal equivalents of the teacher 12 are then relayed to an analog to digital convertor 54 and/or to a comparator circuit 56. The demodulated myoelectric signal equivalents of the student 14 are relayed directly to the comparator circuit 56. A real time/play back circuit 58 is simply an electronic switch that allows for the input of the demodulated signals of the teacher 12 into the comparator circuit 56 on a real time basis, or for the input of such signals as were previously digitized and stored on the computer 30 (generally during a videotaping), as desired.

Where storage of the myoelectric signals of the teacher 12 is desired for future playback, the analog to digital convertor 54, which is of a conventional variety, converts the demodulated myoelectric signal equivalents from their analog voltage or current form into digital bits capable of being read and stored by the computer 30. Prior to storage, the signals may undergo further processing by any manner of software present in the computer 30. Simultaneous to storage of the myoelectric signals, the videotape processing machine 28 provides for a pictorial recordation of the teacher 12 demonstrating the movement behavior to be learned. A synchronizing circuit 60 synchronizes the videotape with the myoelectric signals as both are recorded, placing markers that permit the simultaneous starting and stopping of the videotape and the myoelectric signals on playback, such that movements by the teacher 12 as shown on the videotape result in the output of the corresponding myoelectric signals as would be generated were the demonstration performed "live."

Upon playback, the stored myoelectric signal equivalents are reconverted from their stored digitized form into analog form by digital to analog converter 62, so that signals identical to the originally transmitted and demodulated signals of the teacher 12 are obtained. The reconverted signals then pass to the comparator 56 for comparison with the analogous signals of the student 14 which are generated on a "real time" basis as the student watches the videotaped presentation of the teacher 12 and attempts to replicate the movements depicted therein.

The comparator circuit 56, as noted, has inputs for the demodulated myoelectric signal equivalents of both the teacher 12 and the student 14, the signals of the teacher 14 having been generated on a real time basis or played back from storage, as desired, by using the switching ability of the real time/play back circuit 58. The comparator circuit 56 is provided with circuitry and controls for the normalization of the myoelectric signals of the student 14 relative to those of the teacher 12. The normalized signals of the student 14 are compared with the signals of the teacher 12, and the electrical output representing the difference between the two is then modulated and transmitted back to the student beltpack 22 by a remote processing station modulator/transmitter 64 in order to ultimately provide vibratory feedback, as will be described shortly. The comparator circuit 56 is further provided with delay circuitry for the necessarily non-simultaneous transmission of the two signals to be compared. In certain alternative embodiments of the invention (described below), the function of the comparator circuit may be carried out by software within the computer 30 where the myoelectric signals of the student 14 are digitized similarly to the signals of the teacher 12.

It is contemplated that where a delayed presentation of the motional behavior demonstrated by the teacher 12 is not anticipated or desired, that the remote processing station 18 may be eliminated and the minimum components needed for real time comparison of the myoelectric signals of the teacher 12 and the student 14 incorporated into the teacher beltpack 16. Thus, the output signal of the teacher low pass filter 42 may be received directly into a comparator circuit (similar to comparator circuit 56) present in the teacher beltpack 16. The teacher beltpack 16 would then also contain a receiver/demodulator for the reception and demodulation of the myoelectric signals transmitted from the student beltpack 22. The signals of the student 14 would be inputted into the beltpack comparator circuit and a transmission of the resulting output made back to the student beltpack 22 by a modulator/transmitter before.

Referring again to FIG. 2, a student receiver/demodulator 66 receives and demodulates the transmitted output from the comparator circuit 56 (or from a similar comparator circuit integrally contained in the teacher beltpack 16, as mentioned immediately above). The demodulated feedback signal then passes through a driver circuit 68 which selectively operates any number of the student feedback devices 26 depending on the number of discrepant comparisons determined by the comparator circuit 56. The electronic systems of both the teacher and the student beltpacks (16 and 22) are powered by batteries 70 and 72, respectively, which are conveniently located in the beltpacks (16 and 22).

The student feedback devices 26 are motor driven vibratory devices which, as noted previously, are positioned on the skin of the muscle sites of interest in close proximity to the pair of student electrodes 24 with which a particular student feedback device 26 correlates. The student feedback devices 26, upon activation by the driver circuit 68, provide sensory feedback to the student 14 in the form of vibrations transmitted directly to the skin. The driver circuit 68 is preferably configured to control the speed of the motor of the student feedback device 26 in proportion to the degree of non-compliance of movement attempted by the student 14 and as determined by the comparator circuit 56. Thus, the more the movement behavior performed by the student 14 departs from the ideal as performed by the teacher 12, with a corresponding differential in the normalized myoelectric signal of the student 14 as compared to the myoelectric signal of the teacher 12, the greater the intensity and/or duration of the vibrations that are produced. The student 14 then has at least some idea of the degree to which he or she has not sufficiently duplicated the movement of the teacher 12.

It is to be understood that feedback devices may be provided which are of a type other than vibratory or even skin-stimulating in nature. Audio and video feedback devices are also contemplated as being incorporable in the present invention. An audio feedback device, for example, may produce a sound of a different frequency or pitch for each muscle site under detection when noncompliance is evidenced. A video feedback device might consist of LED's that light up to indicate such noncompliance, the LED's being placed at the muscle sites similarly to the student feedback devices 26 of the preferred embodiment, or arrayed on a panel with appropriate marker designations.

Figure 4:
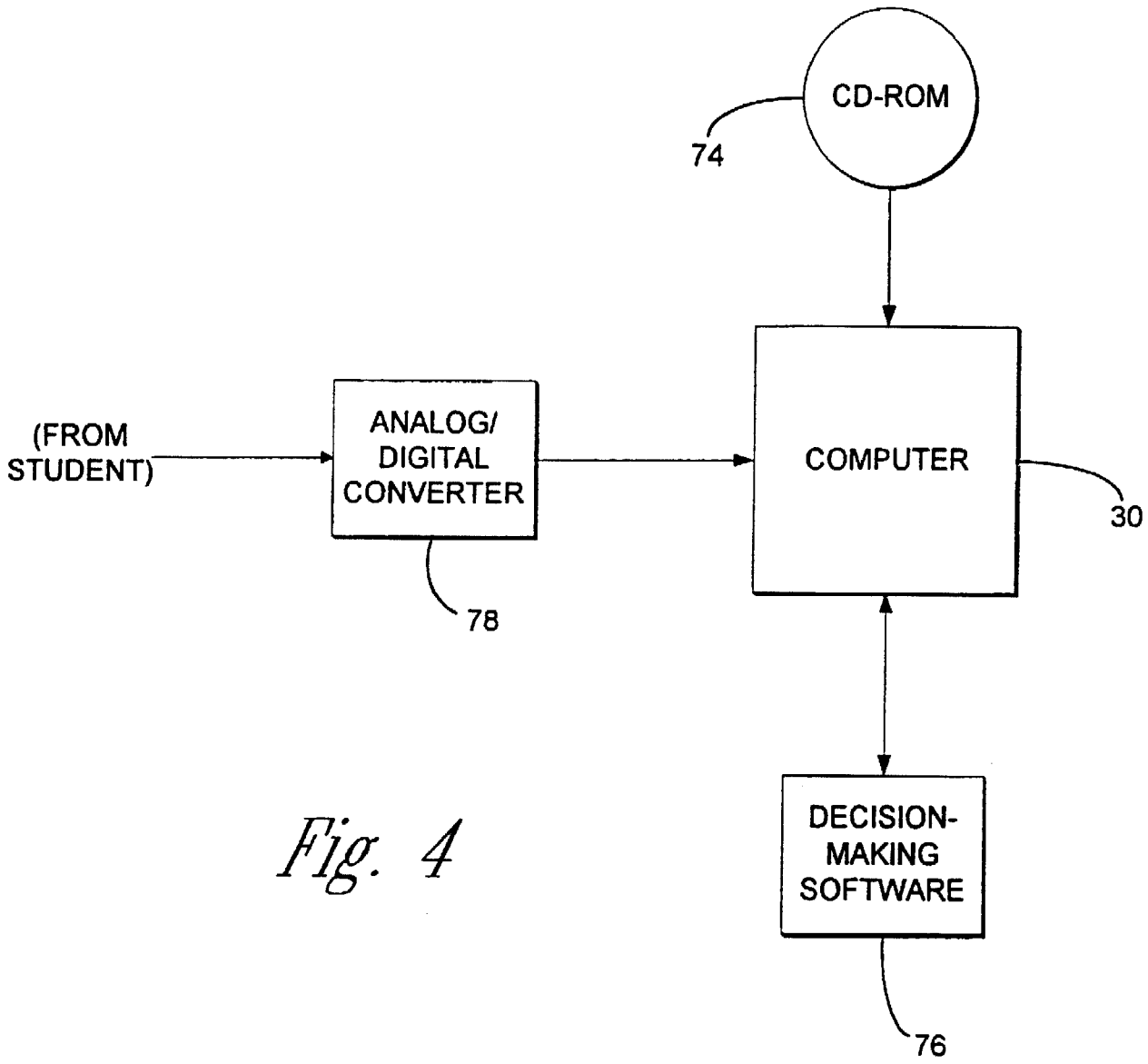
FIG. 4 is an electronics circuit block diagram of certain of the components of an alternative embodiment of the present invention.

An alternative and enhanced embodiment with respect to the delayed or "non-live" teaching capability of the present invention is now presented and the distinguishing components of which shown in FIG. 4. It was previously described that the student 14 may view and attempt to replicate demonstrational behavior as presented by a pre-taped performance of the teacher 12, wherein the components of a videotape processing machine 28 and a synchronizing circuit 60 are employed as part of the basic comparison process set forth by the invention embodied in the myoelectric feedback system 10. However, in addition to digitization of the myoelectric signals of the teacher 12, the video images of the teacher 12 (and of the student 14) may also be digitized, which provides additional benefits as follow below.

Where video images of the teacher 12 are digitized and stored, e.g., on a CD-ROM 74 or on a hard disk present within the computer 30, greater accuracy is achievable with regard to synchronization of the video images and the corresponding myoelectric signals. A digitized video image allows for a close to real time response by instantaneously "remapping" the received myoelectric signal of the student 14 to fit the time interval of the teacher 12 (or vice versa). Access times are reduced for viewing or for additional processing, providing, for example, that subsequent attempts at replication by the student 14 of the viewed movement(s) may be carried out more quickly. More particularly, a reduced access time aids in providing that a myoelectric feedback system 10 of the non-live variety may be enhanced with an interactive capability, as described immediately following.

It is contemplated that decision-making software 76, of the type as is increasingly employed in conjunction with multi-media CD-ROM technology in a variety of interactive games and training applications, be used to offer instructional choices presented by the non-live teacher 12 (or a narrator) which are dependent on the compared myoelectric signals of the student 14 and teacher 12. In this embodiment, and as is shown in FIG. 4, the myoelectric signals generated by the student 14 during an attempted replication are digitized by an analog to digital converter 78 and a comparison of the myoelectric signals of the teacher 12 and student 14 is made by the decision-making software 76. An interactive, problem-solving exchange of one form or another, based on the results of the comparison, then takes place.

An example of the foregoing would be one in which the CD-ROM 74 is a multi-media type CD-ROM(s) containing digitized and recorded images, sounds, and correspondingly generated myoelectric signals of a master golfer (i.e., teacher 12) having demonstrated a proper swing for a drive, sand shot, put, etc. The decision-making software 76 provides that the master golfer reacts differently to an individual student 14 and provides the student 14 with advice and instructional choices of and in one form or another depending on the mix of myoelectric signals received from the student 14. Vibratory feedback to the student 14 can be provided as before (in addition to the verbal, instructional feedback from the interactive, non-live teacher/master golfer 12) to provide the student 14 with tactile reinforcement as to problem areas.

Digital storage of video images of the student 14 may also be provided for, whereby, for example, the interactive enhancement just described may allow for a "replay" of the attempted replication by the student 14. This replay can be complete with analytical commentary from the non-live teacher 12, injected at different stages of the replayed replicated movement (in slow motion, if desired), with determined deficiencies or improvements made mention of therein.

In addition to a training and rehabilitative feedback system based on a comparison of myoelectric signals, as is disclosed by the myoelectric feedback system 10, the inventors also contemplate that similar results may be achievable by an analogous feedback system based on a comparison of positional movements. That is, the teacher 12 and student 14 may be fitted with positional detectors, substantially similar to those as are commonly used in the art of virtual reality, to track the movements of the areas of the body of interest for comparison of those movements as between the teacher 12 and the student 14 on either a real-time or delayed basis as before. Such positional detection may be combined with myoelectric detection to further assist in narrowing trouble spots during the training or rehabilitation session.

In the vein of the foregoing, the conjoining of the various embodiments of the present invention, as set forth previously, with the art of virtual reality is expressly contemplated by the inventors. For example, in an embodiment that employs positional detection (with or without myoelectric detection), such positional detection may be used for both the comparison process and for virtual generation of human figures within a virtual reality environment.

Use of virtual reality technology in conjunction with the myoelectric feedback system 10, or with a comparative feedback system generally, such as have been described, provides many advantages. Virtual reality, similar to a simple video taping of the student 14, allows the student 14 to see the wrongly (or correctly) replicated movement. Furthermore, virtual reality allows the student 14 to see him- or herself (and/or the teacher 12) from different perspectives, or with different magnifications. These different views may further shed light on training problems beyond what can be provided by even complex, traditional videotaping processes.

Virtual reality also provides that the student 14 may perform the desired attempted replications in virtual environs that closely approximate real live environments—environments that might be very difficult, expensive, or dangerous to enter into otherwise. For example, a virtual mountain face could be created for the comparative teaching of various of the maneuvers used in freestyle mountain climbing, or a virtual patient and operating room could be created for the purpose of comparative teaching of a delicate surgical procedure.

In addition to the above mentioned examples, it is to be understood that various other modifications and alterations with regard to the types of materials used, their method of joining and attachment, and the shapes, dimensions, orientations and configurations of the components as described may be made without departing from the invention. Accordingly, the above disclosure is not to be considered as limiting and the appended claims are to interpreted as encompassing the entire spirit and scope of the invention.

INDUSTRIAL APPLICABILITY

The myoelectric feedback system 10 of the present invention is designed to be used in any teaching or rehabilitation context in which a teacher or therapist is attempting to convey by demonstration the manner of performing a certain physical movement or behavior. Typical applications of the preferred embodiment, some of which have been previously mentioned, include teaching of the various martial arts, the playing of musical instruments, sports (even water sports, where the various electronics are suitably protected), and of course all manner of rehabilitative therapies, among many other possibilities. Further expansion of the possibilities occurs through the aforementioned use of virtual reality techniques.

Use of the myoelectric feedback system 10 is simple. Both the teacher 12 and the student 14 place their respective beltpacks (16 and 22) at the waist, while the electrodes (20 and 24) are positioned within the body suit 32 so as to correlate with the relevant locations on the muscles that have been determined to be active (or which should in fact remain passive) in producing the movement to be learned. If it is desired that the teacher 12 be videotaped and the myoelectric signals of the teacher 12 be (digitally) recorded, then the videotape processing machine 28 and computer 30 are turned on so that may occur. (The teacher 12 could, of course, make such a recording out of the presence and purview of any students.) The video images of the teacher 12 may also be digitally recorded, together with the corresponding myoelectric signals, for storage and processing on the CD-ROM 74 of the alternative embodiment of FIG. 4.

The real time/play back circuit 58 is switched to the appropriate setting depending upon whether the teacher's 11 demonstration is live or previously recorded. When the teacher 12 then demonstrates a movement, with subsequent attempted replication by the student 14, the generated myoelectric signals of the teacher 12 (if live) and student 14 are transmitted to the remote processing station 18 and a comparison made by the comparator circuit 56, or by the decision-making software 76 (where the myoelectric signals of the teacher 12 and student 14 have both been digitized as in the shown alternative embodiment). Upon determining that a substantially non-compliant movement by the student 14 has occurred, a feedback signal is transmitted back to the student 14, where activation of the appropriate vibratory feedback device 26 is caused to occur. The student 14 is informed immediately as to whether his or her attempted replication is problematic and, based on prior or simultaneous verbal instructions from the teacher 12, or through interactive processing with the decision-making software 76, the student 14 can then make an appropriate physical adjustment to compensate therefor or have further discussion with the teacher 12.

The described myoelectric feedback system 10 provides for the possibility of greatly accelerated movement behavior learning in teaching and rehabilitative contexts, and makes such learning considerably more interesting and endurable. For these reasons and numerous others as set forth previously herein, it is expected that the industrial applicability and commercial utility of the present invention will be extensive and long lasting.

What is claimed is:

1. A learning system for teaching a movement behavior by a teacher to a student, comprising:

first detection means for producing a first ,electrical signal representative of a movement behavior made by a teacher;

second detection means for producing a second electrical signal representative of a movement behavior made by a student, the movement behavior made by the student made in an effort to substantially duplicate the movement behavior made by the teacher;

comparison means for comparing the first electrical signal with the second electrical signal, said comparison means generating a feedback signal based on the comparison; and feedback means for providing the feedback signal as sensory input to the student.

2. The learning system of claim 1 wherein said first and second detection means includes means for detecting myoelectric activity.

3. The learning system of claim 1 wherein said comparison means includes means for digitizing at least one of the first and second electrical signals, and further includes computer means for storage and processing of such a digitized signal.

4. The learning system of claim 3 further including image processing means for storage and playback of digitized video images of at least one of the teacher and student made while performing the movement behavior to be learned.

5. The learning system of claim 3 further including decision-making software for interactive learning by the student.

6. A neuromuscular training and rehabilitation system for teaching of a movement behavior by a teacher to a student, comprising:

first myoelectric sensing means for producing a first electrical signal representative of myoelectric activity generated by the teacher;

second myoelectric sensing means for producing a second electrical signal representative of myoelectric activity generated by the student;

comparison means for comparing the first electrical signal with the second electrical signal, said comparison means generating a feedback signal if the second electrical signal is relatively dissimilar to the first electrical signal;

first transmission means for transmitting the first electrical signal to said comparator means;

second transmission means for transmitting the second electrical signal to said comparator means; and feedback means for providing the feedback signal as sensory input to the student.

7. The system of claim 6 wherein each of said first and second myoelectric sensing means includes electrode means positioned adjacent to muscle sites determined to be relevant to the movement behavior to be taught for detecting the myoelectric signals of such muscle sites.

8. The system of claim 7 wherein the electrode means include at least one electrode secured to fabric material that may be worn such that the electrode is appropriately positioned at the relevant muscle site by the wearing of the fabric material.

9. The system of claim 6 wherein at least one of said first and second transmission means includes transmitter means and receiver means for wireless transmission of at least one of the first and second electrical signals.

10. The system of claim 6 wherein said feedback means includes vibratory means for providing the sensory input in the form of vibrations perceptible on the skin of the student.

11. The system of claim 6 further including computer means for digital storage and processing of at least one of said first and second electrical signals.

12. The system of claim 11 further including video processing means for video recording and playback of the movement behavior taught by the teacher, and synchronization means for synchronizing such a digitally stored first electrical signal with the video recording.

13. The system of claim 6 wherein each of said first and second myoelectric sensing means includes amplifier means for providing an amplified output and filter means for providing a filtered output.

14. A method of teaching a physical movement, comprising the steps of:

(a) providing means for producing electrical signals representative of the performance by the teacher .of the physical movement when the teacher demonstrates the physical movement;

(b) providing means for producing electrical signals representative of the performance by the student of the physical movement when the student attempts to replicate the demonstration of the teacher;

(c) providing means for comparing the representative electrical signals of the teacher and the student; and (d) providing means for sensory feedback to the student based on the comparison.

15. The method of claim 14 wherein said means for producing representative electrical signals of the teacher and the student includes means for detecting the myoelectric activity generated by the muscles of the teacher and the student during the performance of the physical movement.

16. The method of claim 14 wherein said means for comparing the representative electrical signals of the teacher and the student includes means for digitization of at least one of the representative electrical signals, and further includes computer means for storage and processing of such a digitized representative electrical signal.

17. The method of claim 16 further including the step of (e) providing image processing means for video image storage and playback of the physical movement performed by at least one of the teacher and student.

18. The method of claim 17 further including the step of (f) providing decision-making software for interactive learning by the student.

19. The method of claim 14 wherein said means for comparing the representative electrical signals includes means for wirelessly transmitting at least one of the representative electrical signals.

20. The method of claim 14 wherein said means for sensory feedback includes means for stimulation of the skin of the student.

* * * * *